US006314972B1

(12) United States Patent
Sin

(10) Patent No.: US 6,314,972 B1
(45) Date of Patent: Nov. 13, 2001

(54) DOMESTIC STEAM CLEANING APPLIANCE

(75) Inventor: Timmy Hok Yin Sin, Hong Kong New Territories (HK)

(73) Assignee: Techtronic Industries Co., Ltd., Hong Kong (HK)

( * ) Notice: Subject to any disclaimer, the term of this patent is extended or adjusted under 35 U.S.C. 154(b) by 0 days.

(21) Appl. No.: 09/232,793

(22) Filed: Jan. 19, 1999

(51) Int. Cl.[7] ..... B08B 3/02

(52) U.S. Cl. ..... 134/105; 134/201; 15/32; 68/5 A

(58) Field of Search ..... 134/105, 108, 134/198; 15/320, 321, 322; 68/5 R, 5 A

(56) References Cited

U.S. PATENT DOCUMENTS 2,240,005 * 4/1941 Moyer .
2,292,435 * 8/1942 Crites .
2,908,030 * 10/1959 Schuchman et al. ..... 15/322
3,436,787 * 4/1969 Widsom ..... 15/322
3,701,343 * 10/1972 Bowers .
4,286,735 * 9/1981 Sneider .
5,341,541 * 8/1994 Sham .
5,819,364 * 10/1998 Sham .
6,006,398 * 12/1999 Larson et al. .

* cited by examiner

*Primary Examiner*—Frankie L. Stinson
(74) *Attorney, Agent, or Firm*—Jackson Walker L.L.P.

(57) ABSTRACT

A portable domestic steam cleaning appliance comprises a generally accurate housing having a forward facing barrel portion and a handle portion. A water reservoir is releasably attached to the handle portion. A tube extends into the water reservoir to supply water via a pump to a flash boiler. Steam exits an outlet in use. Power to an embedded heating element is controlled by a thermostat to prevent excessive heating of the boiler. The components are incorporated in the housing that is readily carried in one hand to enable sweeping of attachments that fit to the outlet over surfaces for cleaning and sterilising those surfaces as required. There is no need to carry around or have closely available a significant quantity of water at high temperature or pressurised steam, to provide an adequate supply of steam, being a significant disadvantage over otherwise similar prior art appliances.

14 Claims, 5 Drawing Sheets

DOMESTIC STEAM CLEANING APPLIANCE

BACKGROUND OF THE INVENTION

1. Field of the Invention

The invention relates to domestic steam cleaning appliances.

2. Description of Prior Art

The invention relates more particularly to portable cleaning appliances. Domestic steam cleaning appliances are already available, and where used for general cleaning, de-greasing and sterilising, comprise a steam generator coupled to the appliance by a suitable hose. There are inherent disadvantages resulting from this design. The steam generator is not truly or easily portable, the steam requires first heating up a significant quantity of water and then maintaining steam under pressure for use, both of which require suitable safety precautions, and during delivery along the tube the steam has a tendency to cool down and to condense.

SUMMARY OF THE INVENTION

It is an object of the invention to overcome or at least reduce these problems.

According to the invention there is provided a hand holdable domestic steam cleaning appliance having a generally arcuate single housing comprising a forward facing barrel portion and a handle portion, an elongate electric flash boiler in the barrel portion that converts water into steam supplied by a pump from a reservoir in the handle portion and an outlet nozzle arranged to allow the steam to be ejected from a forward end of the barrel portion, in which the handle portion has a through aperture to receive the fingers of one hand, and in which the pump is mounted generally in line with a longitudinal axis of the boiler and connected to an outlet of the reservoir.

The boiler may comprise an elongate hollow metallic cylinder and an U-shaped embedded electric heating element with limbs extending along the cylinder.

A thermostat may be mounted to the cylinder and arranged to cut off an electrical power supply to the heating element automatically whenever and so long as the temperature exceeds a predetermined value.

A thermostat mounted to the boiler may be included to inhibit the operation of the pump until the boiler temperatures rises to and remains above a predetermined temperature.

The hollow channel of the boiler may be fitted with a split hollow cylindrical metallic liner that slides into the boiler from one end and which split cylinder has a threaded inner surface.

The hollow channel of the boiler may be provided with a flat metallic spiral insert that extends along the length of the hollow channel and is located by the inner surfaces of the hollow channel.

The hollow channel in the boiler may be provided with a metallic insert that extends through the boiler and has an outer surface that fits against the inner surface of the boiler and a wavy inner surface so as to present a significantly increased surface area to water and steam in the boiler, as compared to a regular circular inner surface.

The boiler may include a flow regulator inside the boiler to damper any fluctuations caused by the pump.

The boiler may include a spring biassed flow restrictor inside the boiler to act as a temperature controller for exiting steam from the boiler.

A flexible hose may be connected inside the reservoir for supplying water to the boiler and in which a remote intake end of the tube is weighted so that it automatically falls towards a lowest region in the reservoir.

The outlet may be surrounded by releasable mechanical coupling means for selectively coupling a variety of attachments including brushes, wiping pads, angled nozzles and the like.

The reservoir is preferably held in use to the handle portion and is releasably attachable thereto.

A separate water filter compartment may be included that releasably fits to and between the handle portion and the reservoir.

BRIEF DESCRIPTION OF THE DRAWINGS

A hand holdable domestic steam cleaning appliance according to the invention will now be described by way is of example with reference to the accompanying drawings in which.

DESCRIPTION OF THE PREFERRED EMBODIMENTS

Figure 1:
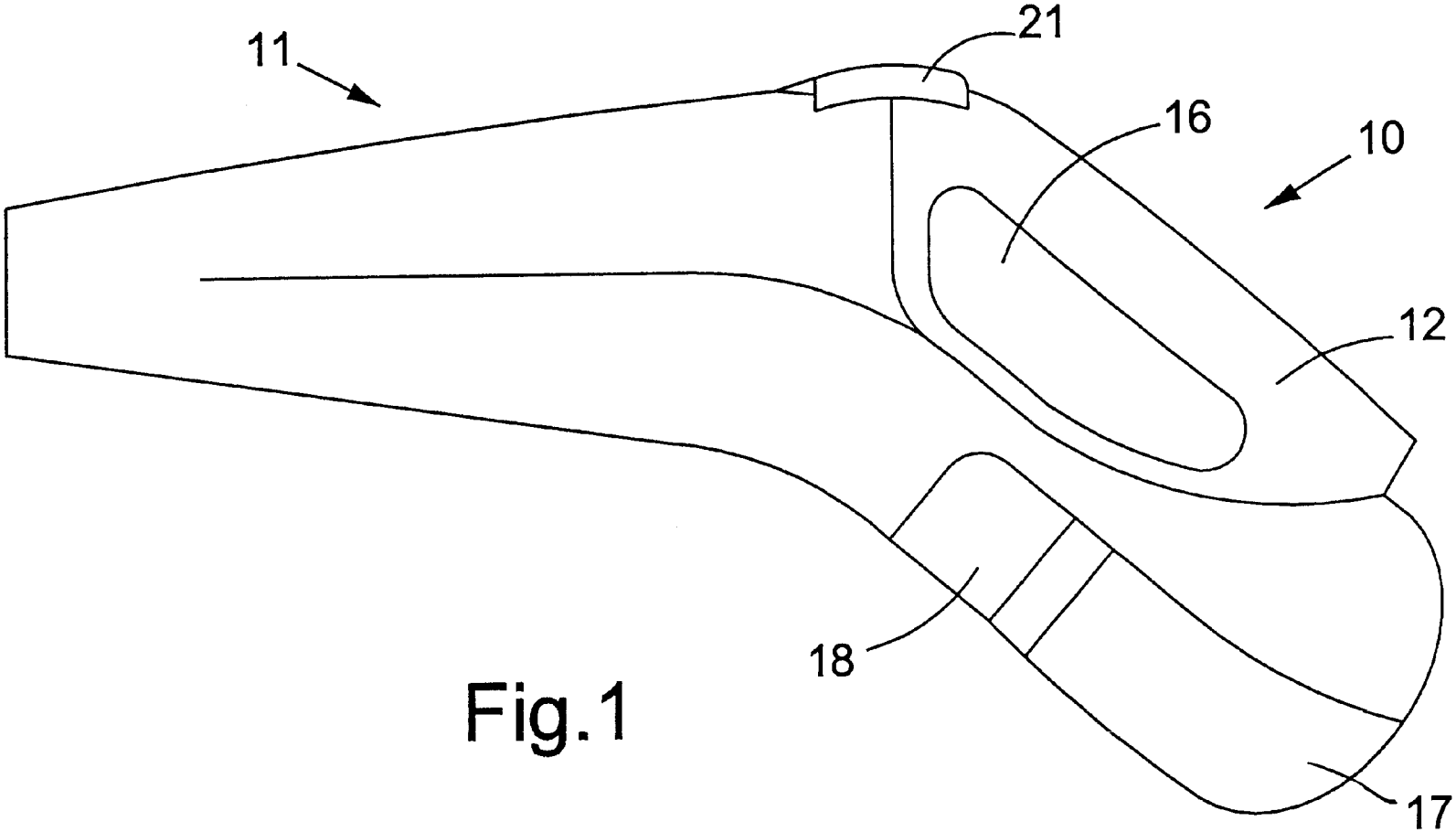
FIG. 1 is a side view of the appliance.
Figure 2:
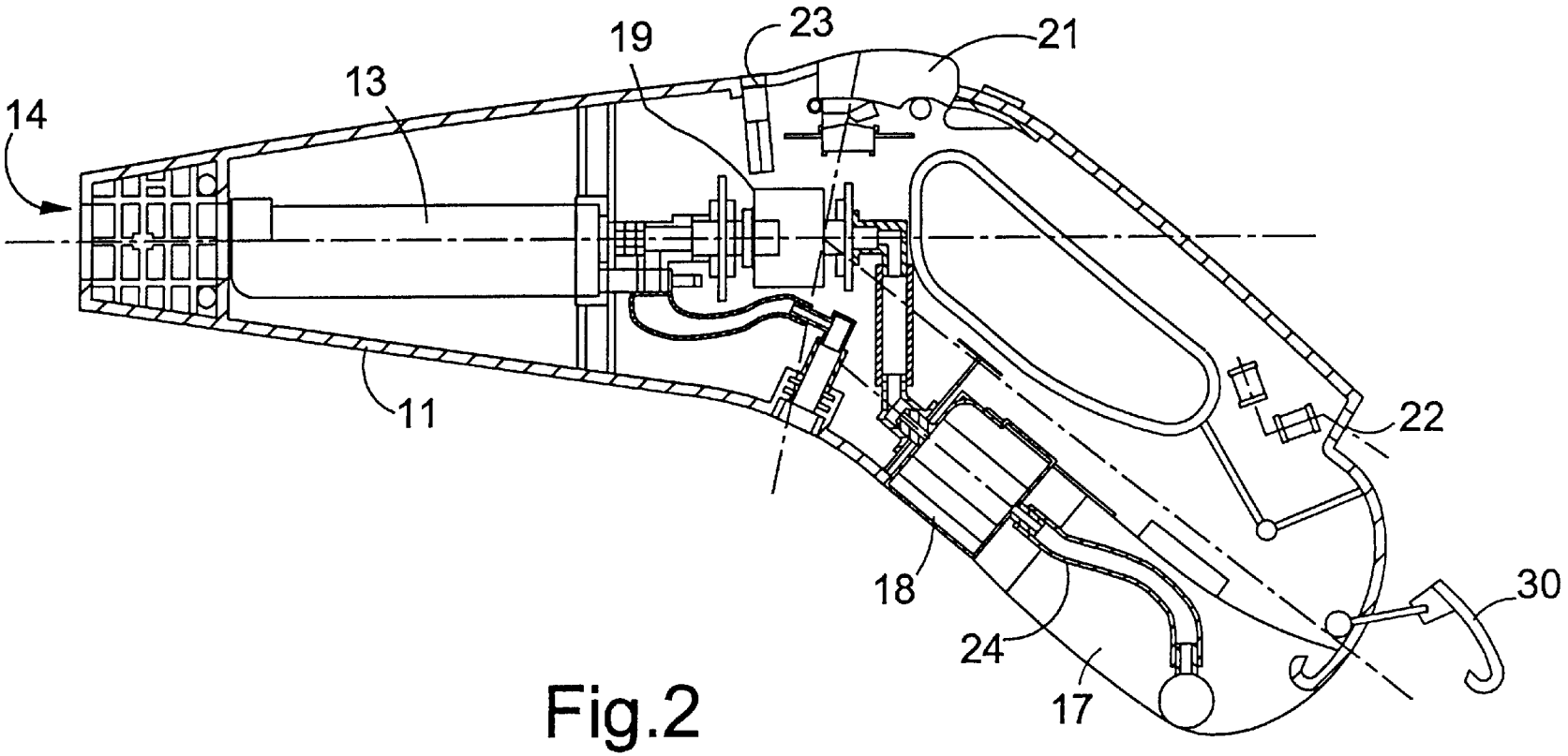
FIG. 2 is a sectional side view of the appliance.

Referring to the drawings, in FIG. 1 the appliance comprises a generally arcuate single housing 10 having a forward facing barrel portion 11 and a handle portion 12. An elongate electric flash boiler 13 and an outlet nozzle 14, seen in FIG. 2, are mounted inside the barrel portion 11. The handle portion 12 has a through-aperture 16 to receive the fingers of one hand of a user. A water reservoir 17 and a water filter compartment 18 releasably fit to the handle portion 12. A pump 19 (seen in FIG. 2) is mounted generally in line with a longitudinal axis of the heater 13 and is connected via the filter compartment 18 to an outlet of the reservoir 17. The appliance includes an operating lever 21 for controlling the operation of the appliance. Power is supplied to the appliance through a cable fitted in use through a port 22. A power supply indicator 23 is mounted on the barrel portion 11 and a thermostat is provided to automatically cut-off power if the boiler becomes excessively hot.

Figure 8:
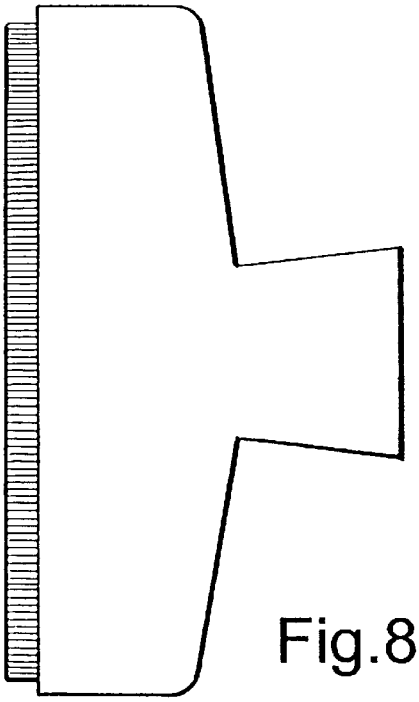
FIG. 8 is a side view of a brush head.
Figure 9:
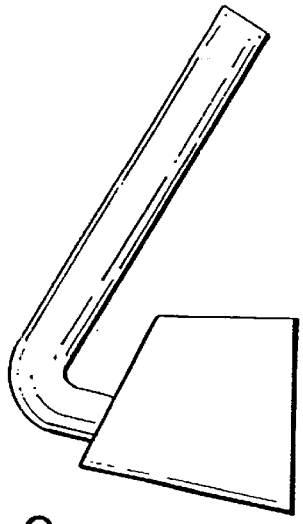
FIG. 9 is a side view of a nozzle.

In FIG. 2, the general layout of the components of the appliance are shown. In use, the appliance is arranged to be held by a single hand of a user and steam directed out of the nozzle 14 for cleaning. The arcuate housing 10 is compact, aesthetically pleasing and comfortable to manipulate using one hand. Various attachments such as a brush FIG. 8, angle nozzle FIG. 9, a wiper pad and the like, can be fitted to the nozzle when required.

Figure 3:
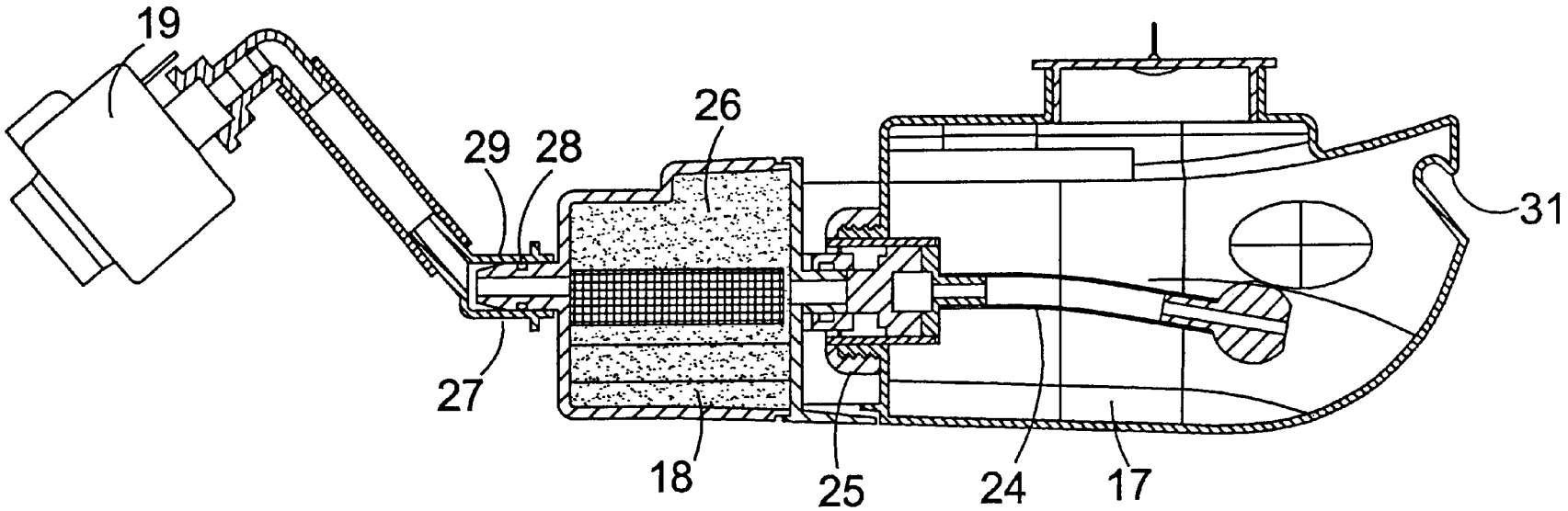
FIG. 3 is a more detail sectional side view of components of the appliance.

Referring to FIG. 3, the reservoir 17 has a flexible is 15 tube 24 with a weighted inlet nozzle at one end so that the nozzle tends to move towards a lowest region inside the reservoir. An outlet of the nozzle 25 is provided with a water sealing coupling that connects to the filter compartment 18.

The filter compartment contains a chemical reaction filter unit 26, that changes colour as its practical function deteriorates, and has a connector 27. The connector 27 has an O-ring seal 28 that is received in a cup 29 leading to the pump 19. In normal use, the filter compartment 18 is fitted to the reservoir and then the connector 27 placed in the cup 27. The reservoir 17 is slid into position against the handle portion and a latch hinge 30 (see FIG. 2) closed against over an integral hook 31 formed in a casing of the reservoir to releasably hold the reservoir 17 in position.

It will be noted in the described appliance that the water flow from the reservoir 17 to the heater 19 is generally as short as possible with this configuration. Also, the pump 19 is physically relatively close to the heater and any vibrations caused by the pump originate on a central axis of the barrel portion 11.

A thermostat 32 is mounted to the outside of the boiler 13 and is electrically connected to inhibit operation of the pump 19 until the boiler temperature has risen to and remains above a predetermined temperature.

Figure 4:
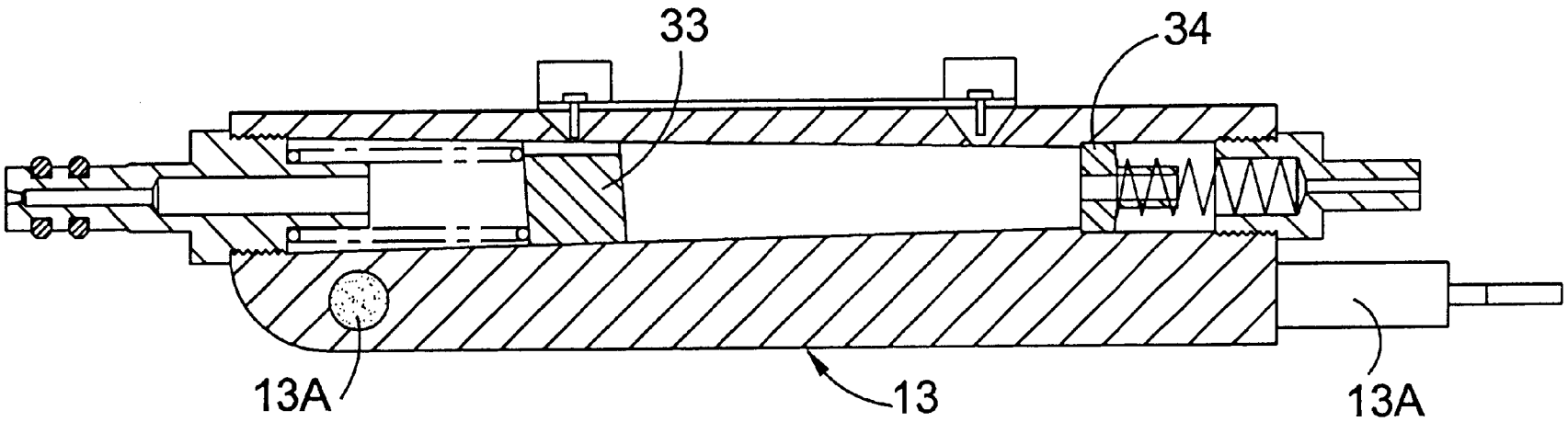
FIG. 4 is a cross-section side view of a boiler in the appliance.

In FIG. 4, the boiler 13 includes an embedded heating element 13A and a flow regulator 33 that has an aperture of chosen diameter. This acts as a damper to reduce pressure fluctuations that may otherwise occur due to variations of steam produced due to pumping. A flow restrictor 34, comprising a spring biassed piston, is arranged to restrict the flow of steam so as control the steam outlet temperature of the boiler 13.

Figure 5:
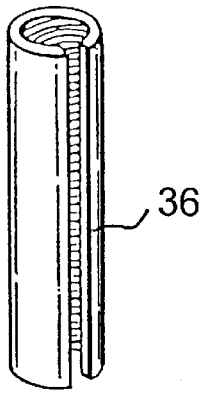
FIG. 5 is an isometric view of a heater insert.
Figure 6:
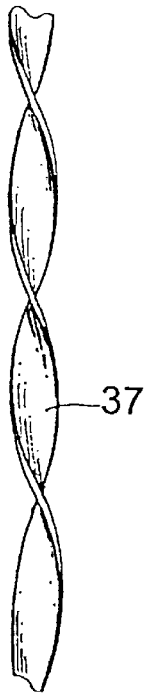
FIG. 6 is an isometric view of another heater insert.
Figure 7:
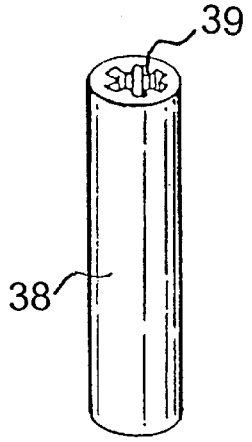
FIG. 7 is an isometric view of a further heater insert.

FIGS. 5, 6 and 7 show different heater inserts that in use can be fitted inside the hollow part of the heater 13.

In FIG. 5, a brass insert 36 is dimensioned to fit inside the boiler 13. The insert 36 comprises a split hollow cylinder that can be inserted from an end of the boiler. The inside surface of the insert 36 is threaded and such an inside surface tends to break up the fluid flow inside the boiler to enhance the conversion of water to steam by improving heat transfer.

In FIG. 6, and to provide a similar function as the brass insert 36, a spiral insert 37 is shown. The insert 17 comprises a flat metal strip twisted into a spiral with its extreme outer edges being supported in use by the internal surface of the boiler 13, If the insert 37 is used in combination with the insert 16 it is made to fit inside the insert 36 as appropriate.

In FIG. 7, the brass insert 38 has a circular outer surface and an inner wavy surface 39. The waves may be smooth or stepped but the purpose of this configuration is to increase the effective surface area of the interface between the heating surfaces of the boiler and the fluid in and passing through the boiler 11.

It will be appreciated that the inserts 36, 37 and 38 can be removed or used for cleaning the inside of the boiler 13 and in general serve to more evenly distribute the heating from the boiler to the fluid in the boiler during use.

What is claimed is:

1. A hand holdable domestic steam cleaning appliance having a generally arcuate single housing comprising a forward facing barrel portion and a handle portion, an elongate electric flash boiler in the barrel portion that converts water into steam supplied by a pump from a reservoir in the handle portion and an outlet nozzle arranged to allow the steam to be ejected from a forward end of the barrel portion, in which the handle portion has a through aperture to receive the fingers of one hand, and in which the pump is mounted generally in line with a longitudinal axis of the boiler and connected to an outlet of the reservoir, and a flexible hose connected inside the reservoir for supplying water to the boiler and in which a remote intake end of the tube is weighted so that it automatically falls towards a lowest region in the reservoir, in which the reservoir forms part of an exposed surface of the handle portion and is slidingly releasably attached to the appliance.

2. An appliance according to claim 1, in which the boiler comprises an elongate hollow metallic cylinder and an U-shaped embedded electric heating element with limbs extending along the cylinder.

3. An appliance according to claim 2, including a thermostat mounted to the cylinder and arranged to cut off an electrical power supply to the heating element automatically whenever and so long as the temperature exceeds a predetermined value.

4. An appliance according to claim 2, in which the hollow channel of the boiler is fitted with a split hollow cylindrical metallic liner that slides into the boiler from one end and which split cylinder has a threaded inner surface.

5. An appliance according to claim 2, in which the hollow channel of the boiler is provided with a flat metallic spiral insert that extends along the length of the hollow channel and is located by the inner surfaces of the hollow channel.

6. An appliance according to claim 2, in which the hollow channel in the boiler is provided with a metallic insert that extends through the boiler and has an outer surface that fits against the inner surface of the boiler and a wavy inner surface so, as to present a significantly increased surface area to water and steam in the boiler, as compared to a regular circular inner surface.

7. An appliance according to claim 2, in which the hollow channel of the boiler is fitted with a split hollow cylindrical metallic liner that slides into the boiler from one end and which split cylinder has a threaded inner surface.

8. An appliance according to claim 2, in which the hollow channel in the boiler is provided with a metallic insert that extends through the boiler and has an outer surface that fits against the inner surface of the boiler and a wavy inner surface so as to present a significantly increased surface area to water and steam in the boiler, as compared to a regular circular inner surface.

9. An appliance according to claim 1, including a thermostat mounted to the boiler to inhibit the operation of the pump until the boiler temperatures rises to and remains above a predetermined temperature.

10. An appliance according to claim 1, including a flow regulator inside the boiler to damper any fluctuations caused by the pump.

11. An appliance according to claim 1, including a spring biassed flow restrictor inside the boiler to act as a temperature controller for exiting steam from the boiler.

12. An appliance according to claim 1, in which the outlet is surrounded by releasable mechanical coupling means for selectively coupling a variety of attachments including brushes, wiping pads, angled nozzles and the like.

13. An appliance according to claim 1, in which the reservoir is held in use to the handle portion and is releasably attachable thereto.

14. An appliance according to claim 13, including a separate water filter compartment that releasably fits to and between the handle portion and the reservoir automatically falls towards a lowest region in the reservoir.

* * * * *